United States Patent [19]

Wear et al.

[11] Patent Number: 4,640,020

[45] Date of Patent: Feb. 3, 1987

[54] ZONED MICROWAVE DRYING APPARATUS AND PROCESS

[75] Inventors: Frederick C. Wear; Howard F. McKinney, both of St. Louis County, Mo.

[73] Assignee: McDonnell Douglas Corporation, St. Louis, Mo.

[21] Appl. No.: 802,265

[22] Filed: Nov. 27, 1985

[51] Int. Cl.[4] ..... F26B 3/347

[52] U.S. Cl. ..... 34/1; 34/92; 34/68; 34/216; 219/10.55 R; 219/10.55 M

[58] Field of Search ..... 219/10.55 R, 10.55 D, 219/10.55 M; 34/1, 4, 92, 15, 39, 68, 213, 214, 216, 217

[56] References Cited

U.S. PATENT DOCUMENTS

| | | | |
|---|---|---|---|
| 3,277,580 | 10/1966 | Tooby | 34/1 |
| 3,347,740 | 10/1967 | Goumeniouk | 34/111 |
| 3,885,118 | 5/1975 | Valtersson | 219/10.55 D |
| 4,015,341 | 4/1977 | McKinney et al. | 34/4 |
| 4,045,639 | 8/1977 | Meisel | 219/10.55 R |
| 4,229,886 | 10/1980 | Durant | 34/92 |
| 4,347,670 | 9/1982 | Wear et al. | 34/167 |
| 4,418,083 | 11/1983 | McKinney et al. | 34/15 |

*Primary Examiner*—Larry I. Schwartz

*Attorney, Agent, or Firm*—Gravely, Lieder & Woodruff

[57] ABSTRACT

An apparatus for drying nodular, granular and other products includes a vessel containing an evacuated chamber and an endless belt conveyor that passes through the chamber. Microwave energy is supplied to the chamber by several microwave generators, with each generator supplying energy for a different zone along the belt. The moisture-laden product is introduced into the chamber without affecting the pressure within the chamber, and is then distributed onto the conveyor belt at uniform thickness and width. The belt transports the product through the zones of microwave energy, and within each zone the strength of the field is below the breakdown point of the field for the particular pressure of the chamber, so the destructive effects of ionization are avoided. By reason of the greater moisture content in the product at the first zone, more energy can be supplied to the product in that zone, and indeed the energy supplied diminishes with each successive zone. Beyond the last microwave zone the product is transferred to another endless belt conveyor which moves the product beneath the microwave zones. Here it may be heated with radiant energy to drive off still more moisture and perhaps cooled to crystallize sugar that may be within the product. A dry purge gas is passed over the product where it is radiantly heated to carry away the vapor from the additional moisture, and more of the gas is passed over the product where it is cooled to prevent condensation on cooling panels.

28 Claims, 4 Drawing Figures

FIG. 2
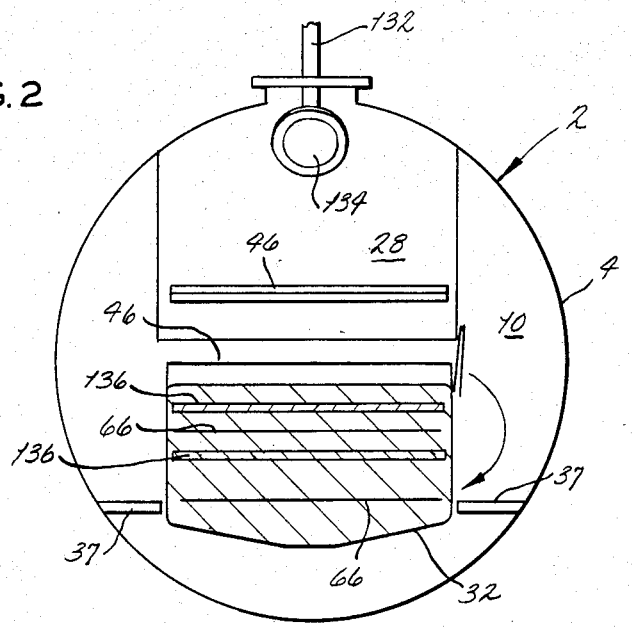
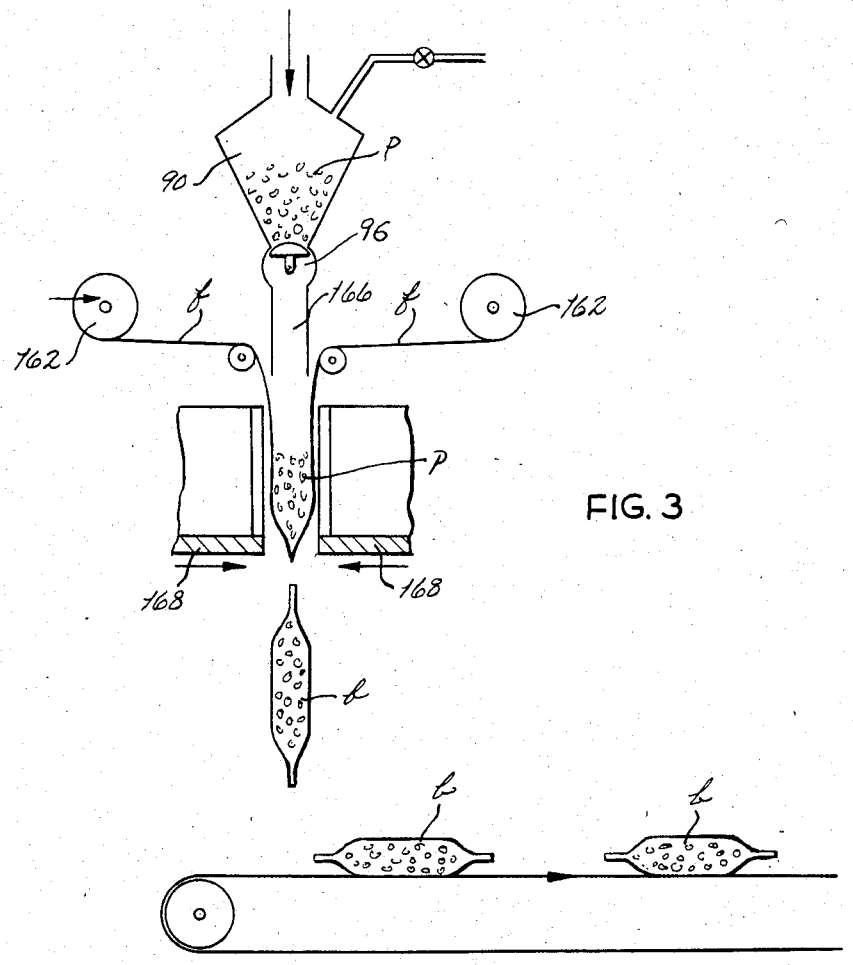
FIG. 3

ZONED MICROWAVE DRYING APPARATUS AND PROCESS

BACKGROUND OF THE INVENTION

This invention relates in general to drying moist materials or products, and more particularly to a process and apparatus for drying granular, nodular and other products by subjecting those products to successive zones of microwave energy.

Some products which are produced or acquired in a moist condition are temperature-sensitive, in that elevated temperatures have deleterious effects on such products. Hence, care must be exercised in drying these products.

Perhaps the most common of these temperature-sensitive products are numerous seed or food products which are nodular in nature, that is consisting of relatively small increments such as seeds, nodules, or slices. Grapes, fruits and vegetables, processed meat slices and grain seeds are typical. These products often contain large amounts of moisture, which must be removed if the product is to be stored. In the past, seed and food processors have used hot air driers for this purpose. However, in the case of seed products, these devices elevate the temperature of the seed so high that the seed in many instances is incapable of germinating. In the case of food products, the excessively high temperatures may harden the product, may detract from its flavor, and may impair its ability to withstand long periods of storage. Aside from that, hot air driers consume enormous amounts of fuel and produce considerable dust.

Microwave driers eliminate or reduce many of the foregoing problems and have been used to successfully dry granular and nodular seed and food products, as well as other products, but these devices in their current configurations produce problems of their own. For example, microwave drying is most effective at reduced pressures on the order of 0.1 to 50 Torr, but at these pressures the gases tend to ionize in the presence of microwave energy, producing a phenomenon known as glow discharge which scorches the product being dried and further damages windows through which microwave energy enters the evacuated chamber in which the drying takes place. To avoid glow discharge, the strength of the microwave field must be kept below the breakdown point of the field for the particular pressure at which the evacuated chamber exists. However, for a given power level at the microwave generator, the field strength varies inversely with respect to the amount of moisture in the product. As the moisture decreases, the field strength increases. As a consequence, either the power density must be decreased as the drying progresses, or the maximum power density must be limited by the strength of the field produced when the product is in its driest condition. Decreasing the power is suitable for batch processing and has heretofore been practiced by others, but drying large quantities of product in batches does not lend itself to high speed processing. Continuous processing in which the material is conveyed through a vacuum chamber at a generally uniform velocity must take place at a constant power level, and that power is determined by the strength of the microwave field in the region of the chamber where the product is driest, for the strength of the field where the product possesses a greater amount of moisture will always be less—there being more moisture in that region to absorb the microwave energy.

Since the power that is introduced into a vacuum chamber in a continuous process is limited by the dielectric characteristics of the driest part of the product within the chamber, the chamber in order to achieve reasonable production quantities must be quite long. In other words, by virtue of the fact that the field is quite weak to accommodate the driest product, the vacuum chamber must be quite long to provide enough residence time in the field to dry the product. At that some moisture remains in the product, for one must operate the microwave drier somewhat below the limit at which glow discharge and scorching will occur to allow margin for error.

Some food products such as grapes, when dried in a vacuum with microwave energy produce a unique and appealing snack food having a puff-like consistency—much in contrast to the traditional raisin. During the microwave drying the temperature of the grapes reaches 170° F. to 200° F.—high enough to cause the sugars in the grapes to become somewhat plastic. Unless the temperature of the heated grapes is thereupon reduced to about 100° F. or less, where the sugars crystallize or otherwise solidify, the grape will collapse upon being subjected to air at atmospheric pressure and will thus lose its puffer or inflated shape—a shape which renders the grape most suitable for use as a snack. Heretofore the temperature reduction has required execessive residence time in the drier, consuming capacity that might otherwise be used for drying or perhaps requiring excessively large vacuum chambers. The grape puff and the process for producing it are described in more detail in U.S. Pat. No. 4,418,083 to H. McKinney, F. Wear and H. Sandy.

U.S. Pat. Nos. 4,015,341, 4,045,639 and 4,347,670 show apparatus for drying seeds and foods in vacuum chambers with microwave energy. Other products such as pharmaceuticals may be dried using similar apparatus and processes.

SUMMARY OF THE INVENTION

One of the principal objects of the present invention is to provide an apparatus for drying granular, nodular and other products with microwave energy at low pressures while avoiding ionization and the accompanying destructive effects of glow discharge. Another object is to provide an apparatus of the type stated which is not excessively large. A further object is to provide an apparatus of the type stated in which the strength of the microwave field is not limited by the dielectric characteristics of the driest material in the vacuum chamber. An additional object is to provide an apparatus of the type stated in which the material, as it is dried, passes through zones of varying field strength, and perhaps varying frequency as well. Still another object is to provide an apparatus of the type stated which provides radiant heating beyond the microwave field to extract additional moisture. A further object is to provide an apparatus of the type stated which is capable of cooling products which become soft due to the heat that develops in the microwave field so that such products do not collapse upon emerging from the vacuum chamber. Another object is to provide an improved process for drying material by subjecting the material to microwave energy in zones of varying field strength. Yet another object is to provide an apparatus of the type stated that is ideally suited for drying seed and food products. These and other objects and advantages will become apparent hereinafter.

DESCRIPTION OF THE DRAWINGS

In the accompanying drawings which form part of the specification and wherein like numerals and letters refer to like parts wherever they occur

FIG. 2 is a transverse sectional view of the drying apparatus taken along line 2—2 of FIG. 1;

FIG. 3 is a sectional view of a device for packaging the dried product; and

DETAILED DESCRIPTION

Figure 1:
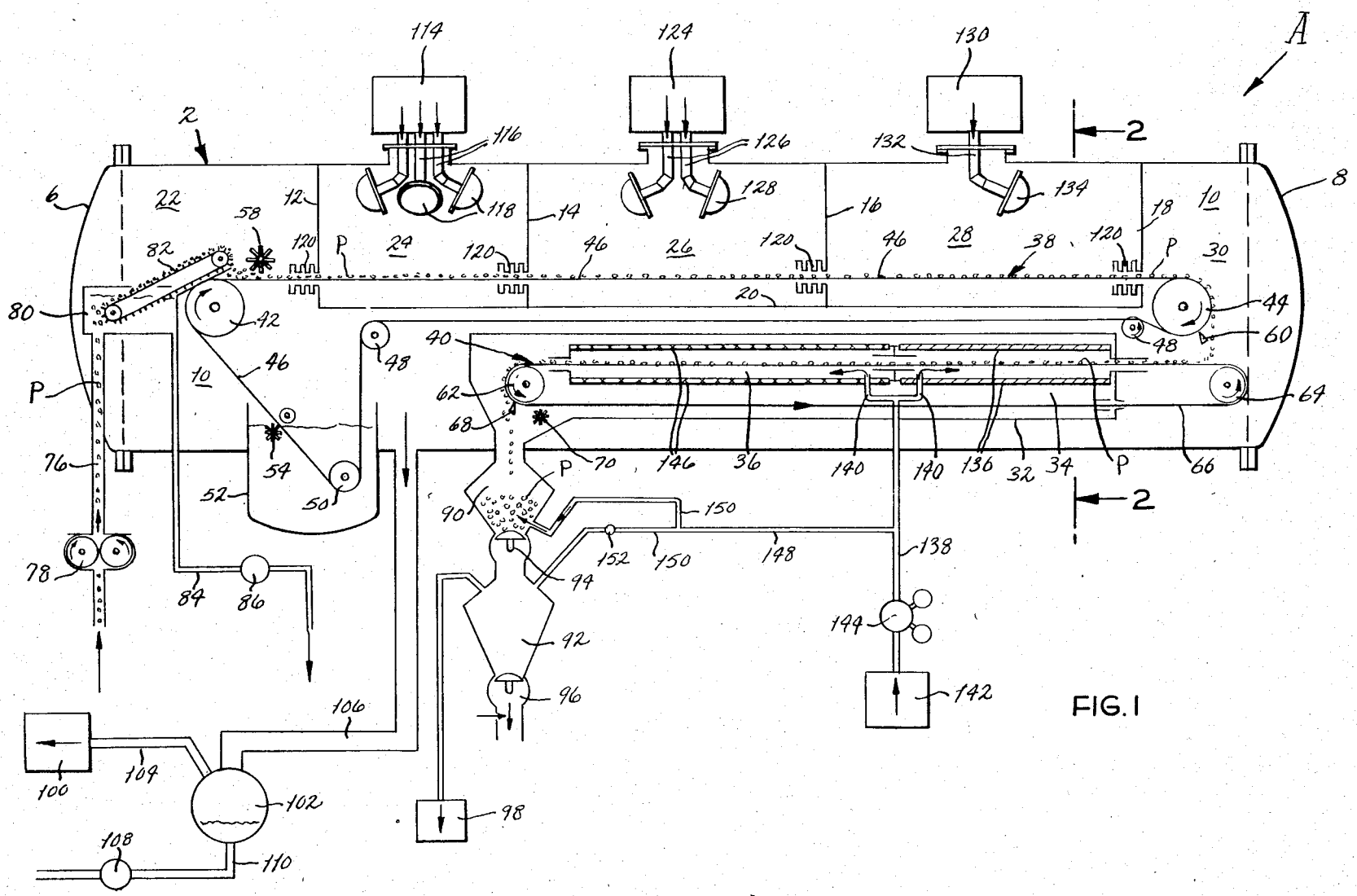
FIG. 1 is a longitudinal sectional view of a drying apparatus constructed in accordance with and embodying the present invention.

Referring now to the drawings, a drying apparatus A (FIG. 1) is capable of drying nodular or granular products p or for that matter any other product p that is capable of being deposited on and carried by an endless belt conveyor, all by subjecting the product p to microwave energy as it passes through a vacuum chamber in the apparatus A. To this end, the interior of the apparatus is maintained at a reduced pressure usually between 0.1 and 50 Torr (1 Torr=1 mm Hg), the particular pressure being dependent on the product, inasmuch as each produce has an optimum pressure or pressure range. For example, grapes and fruits and vegetables are best dried at between 30 to 50 Torr, whereas processed meat products should be dried between 0.1 and 1.0 Torr. As the product p advances it passes through microwave heating zones, the amount of microwave energy supplied to the product p varies from zone to zone, becoming progressly less along the path of the advancement through the vacuum chamber. Thus, the product p when in its wettest condition is exposed to more microwave energy than when in its driest condition. In each zone the amount of energy supplied for that zone is governed by the driest material in the zone, and that energy should be below the level at which the microwave energy causes gases in the zone to ionize and produce a destructive phenomenon known as glow discharge.

As to each zone, the amount of power supplied per unit volume of product p by the microwave field is governed by the following formula:

$$P=0.278E^2f\epsilon''(10^{-6}),$$

where

P is the energy dissipated per unit of product ($W/cm^3$),

E is the field strength (V/cm), f is the frequency (MHz), $\epsilon''$ is the dielectric loss factor for the product and varies with the moisture content of the product (no units), and 0.278 is a constant containing units which balance the equation.

The dielectric loss factor $\epsilon''$ varies from product to product, and further varies for any given product, depending on the amount of moisture in the product. When the moisture content is high, the loss factor $\epsilon''$ is high and when the moisture content is low, the loss factor $\epsilon''$ is low, with the loss factor $\epsilon''$ and the moisture content, generally speaking, being directly proportional. For example, a specific food product with a moisture content of 80%, may have dielectric loss factor $\epsilon''$ of about 12, but when the moisture content of that product diminishes to 3%, the dielectric loss factor $\epsilon''$ is typically on the order of 0.6. Of course the values vary from product to product, but nevertheless it is characteristic for a product to show a reduction in its dielectric loss factor $\epsilon''$ as its moisture content decreases. Thus, the dielectric loss factor $\epsilon''$ is representative of the amount of moisture in the product that is being dried, and since the amount of moisture decreases as the product passes through the apparatus A, the dielectric loss factor $\epsilon''$ likewise decreases.

Within any zone the field strength E is maintained below that at which ionization and accompanying glow discharge occur, and generally speaking the ionization is more likely to occur at low pressures. Indeed, the field strength at which the field breaks down and ionization occurs at any particular pressure and at varying frequencies may be depicted graphically (FIG. 2). As a practical matter only two frequencies are of interest—namely 915 MHz and 2450 MHz—for the FCC has allotted these frequencies for heating and equipment is available for generating power at these frequencies. Other lower radio frequencies are available for heating, but they require elevated field strengths and are not suitable for use in low pressure environments. Beyond about 10 Torr the field breaks down at about the same point for the two frequencies. It is in the region between 0.1 and 50 Torr that the product p is dried.

Not only is the energy of the microwave field in any zone kept below the level at which glow discharge occurs, it is kept safely below that level, since the moisture content of the product p in the zone will vary somewhat, and this is particularly true of the last zone, for the product p passing through preceding zones may not dry uniformly. Thus, even the presence of a drier than normal product p in the last zone will not trigger glow discharge. However, the product may leave the last zone with more moisture than desired, and to reduce the moisture content this last increment to the desired level, at least insofar as some products are concerned, the product may be passed, while it is still in the vacuum chamber, through a radiant heating zone where it is subjected to radiant heating and a gas purge. The latter prevents the moisture which the radiant heat extracts from again being absorbed by the product p.

Some products contain sugars which become plastic at the elevated temperatures encountered in the microwave zones and the radiant heating zone where the drying actually occurs. These sugars normally give rigidity or body to the product p, and unless they are solidified or crystallized before the product emerges from the vacuum chamber, nodules of the product p will collapse in atmospheric air and further adhere to one another. The vacuum chamber also contains a cooling zone beyond the radiant heating zone to reduce the temperature of the product. This zone is likewise purged with a gas to carry moisture away and thereby prevent condensation on cooling surfaces.

Perhaps the apparatus A assumes its most complex form when used to dry fruits and grapes, and accordingly the apparatus A will be described in that form. Thus, when the product p is a fruit in nodular form, the apparatus A includes (FIG. 1) a pressure vessel 2 which is formed from an electrically conductive material, such as nonmagnetic stainless steel, or at least is lined with such a material, so that its interior surfaces will reflect microwave radiation. The vessel 2 has a cylindrical wall 4 and domed end walls 6 and 8 all of which are joined together to enclose an air tight chamber 10 that is capable of being evacuated to a pressure on the order of 30 Torr and even less. The chamber 10 is divided into successive zones by partitions or septums 12, 14, 16, and 18, which are attached to the cylindrical wall 4 and are arranged in that order from one end to the other of the chamber 10 and by a shield 20 which is attached to the lower ends of the septums 12, 14, 16, and 18 and extends from the first septum 12 to the last septum 18. Like the cylindrical wall 4, the septums 12, 14, 16, and 18 and the shield 20 are formed from an electrically conductive substance, such as nonmagnetic stainless steel, but in contrast they are perforated (FIG. 2) so as to permit the free flow of moisture and air between the zones. The perforations, however, are arranged so that they do not pass microwave energy from one zone to the other, nor to the region below the shield 20. The space between the end wall 6 and the first septum 12 constitutes a loading zone 22, and it is substantially free of microwave energy. The space between the septums 12 and 14 and above the shield 20 represents a first microwave zone 24 where the power density P is relatively high. The space between the septums 14 and 16 and above the shield 20 represents a second microwave zone 26 where the power density P is less. The space between the septums 16 and 18 and above the shield 20 constitutes a third microwave zone 28 where the power density P is even lower than that of the zone 26. The space beyond the septum 18, that is between the septum 18 and the end wall 8, represents a transfer zone 30 in which substantially no microwave energy exists. The shield 20 confines the microwave radiation generally to the upper portion of the chamber 10 and isolates the region below it from such radiation. Within this isolated region is a housing 32 (FIGS. 1 and 2) containing a radiant heating zone 34 and a cooling zone 36, the former being directly beneath the last microwave zone 28 and the latter generally beneath the intermediate microwave zone 26. The housing 32 has hinged sidewalls which are accessible from walkways 37 in the lower portion of the chamber 10.

The vacuum chamber 10 also contains an upper conveyor 38 (FIG. 1) which carries the product from the loading zone 22 through the three microwave zones 24, 26 and 28 in that order and into the transfer zone 30, and a lower conveyor 40 which receives the product p from the upper conveyor 38 and carries it through the radiant heating zone 34 and the cooling zone 36 in the housing 32, beyond which the product p is discharged from the chamber 10. Thus, the upper conveyor 38 advances the product p toward the transfer zone 30, whereas the lower conveyor 40 moves it in the opposite direction away from the transfer zone 30.

The upper conveyor 36 includes (FIG. 1) a head pulley 42 which is located in the loading zone 22, a tail pulley 44 located in the transfer zone 30, and an endless belt 46 which passes around the pulleys 42 and 44 so as to have upper and lower passes. The upper pass actually conveys the product p, and it extends horizontally between the two pulleys 42 and 44 without interruption in direction. In so doing, it passes through the three microwave zones 22, 24 and 28, there being apertures in the septums 12, 14, 16, and 18 for accommodating the upper pass. The lower pass is located entirely below the shield 20 where much of its extends through the space between the shield 20 and the housing 22, it being supported on idler pulleys 48 in this region. However, at the loading zone 22 and in the adjacent region below the first microwave zone 24, another idler pulley 50 diverts the lower pass downwardly into a washing tank 52 that is built into and sealed to the cylindrical wall 4. The tank 52 contains wash water, and by reason of the idler pulley 50 the belt 46 is carried through the water on its return to the head pulley 42. Near the surface of the water in the tank 52 are washing brushes 54, there being one against each surface of the belt 46, and these brushes revolve such that where they bear against the belt 46 they move opposite to the direction of advancement for the belt 46. Thus, the brushes 52 scrub product debris from both surfaces of the belt 46 immediately ahead of the head pulley 42 in terms of the direction of advance. The washing tank 52, even though it projects below the cylindrical wall 4 of the vessel 2, is well insulated from the surrounding environment so that the wash water absorbs a minimum amount of heat.

The conveyor belt 46 is formed from a material that is transparent to microwave energy, and it is powered by a drive motor (not shown) which is coupled to the tail pulley 44. The motor 36 imparts a uniform velocity to the belt 46, such that its upper pass moves from the head pulley 42 to the tail pulley 44.

In addition, the upper conveyor 38 includes a product leveling wheel 58 which rotates in the loading zones 22 above the upper pass immediately beyond the location where the upper pass pays off of the head pulley 42. Actually the wheel 58 carries paddles, the peripheries of which pass close to, yet are spaced somewhat above, the upper pass of the belt 52. Indeed, the spacing approximates the depth desired for the product p on the belt as the product p is carried through the microwave zones 24, 26 and 28. In this regard, the wheel 58 revolves such that the peripheral velocity of its paddles is less than that of the underlying belt 46, and this causes the product p to spread laterally over the upper pass of the belt 46 and assume a generally uniform depth on the belt 46.

The upper pass of the belt 46 carries the product p through the three microwave zones 22, 24 and 28 and into the transfer zone 30 where it drops downwardly onto the lower conveyor 40 as the belt 46 moves over the tail pulley 44. Immediately beyond the location where the product p separates from the belt 46, is a scaper blade 60 which bears against the surface of the belt 46 to loosen any product p which clings to the belt 46.

The lower conveyor 40, like the upper conveyor 38, includes (FIG. 2) a head pulley 62, a tail pulley 64, and an endless belt 66 that passes around the pulleys 62 and 64. The belt 66 has upper and lower passes that extend horizontally between the pulleys 62 and 64 where they are for the most part contained within the housing 32, but the housing 32 is provided with openings for accommodating the entry and exit of the belt 66. Indeed, the head pulley 62 is located beyond the housing 32 within the transfer zone 30 and is further located beyond the tail pulley 44 of the upper conveyor 38, so that the product p which leaves the upper conveyor 30 at its tail pulley 44 drops downwardly onto the upper pass of the belt 66 for the lower conveyor 40. The tail pulley 64, on the other hand, is located within the housing 32. The belt 66 need not be made from a material that is transparent to microwave radiation, but it should be porous to effect maximum heating of the product in the radiant heating zone 34 and cooling in the cooling zone 36.

The lower conveyor 40 opposite to the lower portion of its tail pulley 44 likewise has a scraper blade 68 which bears against the belt 66 slightly beyond the location where the product drops from it, this being to remove any product p which otherwise clings to the belt 66. Immediately beyond the scraper blade 68 is a brush 70 which bears against the lower pass of the belt 66, its direction at the region of contact being opposite to that of the belt 66. Thus, the brush 70 removes any remaining debris from the belt 66.

The belt 66 of the lower conveyor 40 is powered by a drive motor (not shown) which is coupled with the tail pulley 64 to turn the same.

The product p is introduced into a loading zone 22 through a device which does not impair the vacuum that is maintained in the chamber 2. A conventional air lock of the type set forth in U.S. Pat. No. 4,347,670 is suitable for this purpose, particularly where the product p is of relatively solid and durable consistency, such as corn and soy beans. On the other hand, where the product p is fragile, as are grapes, it may be introduced as part of a slurry which is pumped into the loading zone 22. More specifically, the slurry containing the product p is delivered to the loading zone 22 through an inlet pipe 76 which passes through the end wall 6 and contains a positive displacement pump 78 such as a gear-type solids pump. Within the loading zone 22 is a reservoir 80 for receiving the slurry, and the pipe 76 is connected to the reservoir 80. The level of the slurry within the reservoir 80 is below the elevation of the upper pass for the belt 46 of the upper conveyor 38, and the product p is separated from the slurry and lifted out of the reservoir 80 by an endless belt conveyor 82 having one end in the reservoir and the other above the head pulley 42 where the upper pass of the belt 46 commences. To this end, the belt of the conveyor 82 has outwardly presented ribs which form troughs that trap the product p, but not the water. The conveyor 82 deposits the product p, on the upper pass of the belt 46 for the upper conveyor 38, behind the leveling wheel 58, so that the belt 46 conveys the product p beneath the wheel 58 which spreads it and causes it to assume a uniform depth.

The reservoir 80 is drained through a drain pipe 84 which extends downwardly and passes through the cylindrical wall 4 of the pressure vessel 2. Beyond the vessel 2 it is connected with a pump 86 which works against atmospheric air to preserve the vacuum in the chamber 10.

The housing 32 at the discharge end of the belt 66 for the lower conveyor 40 opens into a product accumulator 90 which is located below the pressure vessel 2, yet the vessel is sealed to the accumulator 90 so that the interior of the accumulator 90 remains at the low pressure of the chamber 10. The arrangement is such that the dried product p, upon passing over the head pulley 62 for the lower conveyor 40 drops directly downwardly into the accumulator 90 where it collects. The accumulator 90 in turn is connected with a suitable air lock septum for removing the product p from the accumulator 90 without disrupting the vacuum in the chamber 10. This septum may comprise nothing more than a simple lock hopper 92 having a valve 94 at its upper end where it couples with the accumulator 90, another valve 96 at its lower end, and a pump 98 for evacuating it. The valves 94 and 96 are of course large enough to enable the product p to pass through them, yet are air-tight so that they can be sealed tightly enough to maintain the vacuum in the chamber 10. The valves 94 and 96 operate alternately such that one is always closed, and this maintains the vacuum in the chamber 10.

The vacuum chamber 10 is evacuated with a vacuum pump 100 (FIG. 1) which withdraws air and water vapor from the chamber 10, but the water vapor is for the most part removed at a condenser 102, so that that pump 100 draws primarily air. In this regard, the pump 100 is connected to the condenser 102 through a vacuum line 104, while the condenser 102 is connected to the vacuum chamber 10 through another vacuum line 106 that is sealed to the cylindrical wall 4 of the pressure vessel 2 at the bottom of the vessel 2. The water that is condensed from the water vapor at the condenser 102 is withdrawn from the condenser 102 by a condensate pump 108 that is connected to the condenser 102 through a condensate line 110 and in effect operates against atmospheric air. Thus, the vacuum pump 100 creates the vacuum in the chamber 10, while the condensate pump 108 and the liquid removal pump 78, by working against atmospheric air, serve to preserve that vacuum.

Figure 4:
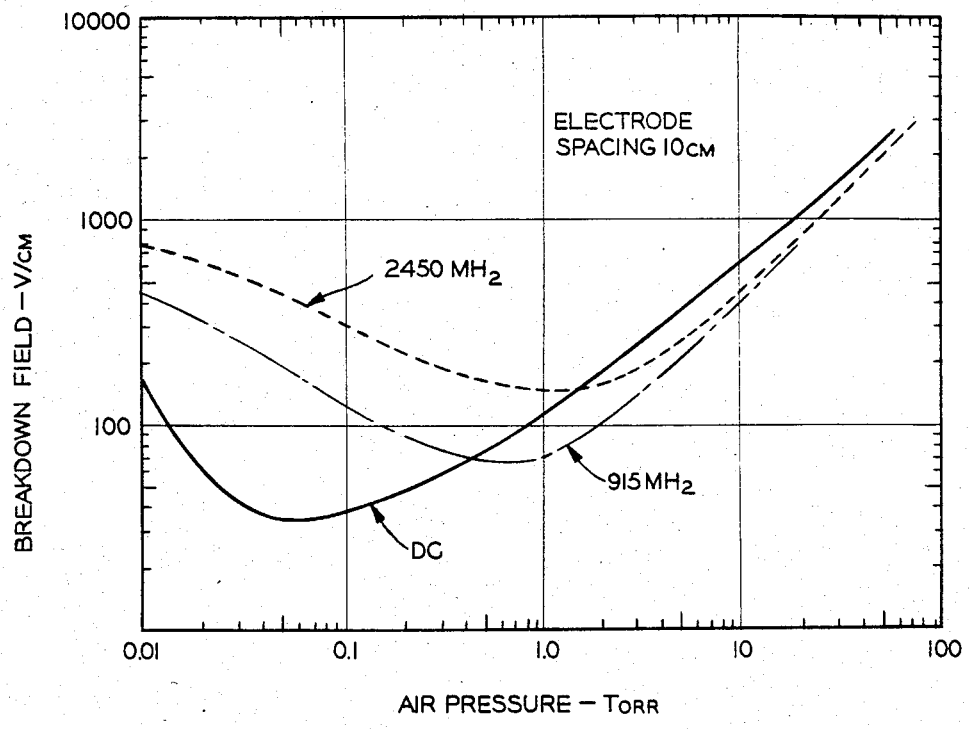
FIG. 4 is a graph depicting the relationship between pressure and field strength for the break down of microwave fields at two frequencies commonly used for microwave generators and for direct current as well.

The microwave energy for the first microwave zone 24 is derived from a microwave generator 114 (FIG. 1) which is located outside of the vessel 2. It is connected with three wave guides 116 which lead through the cylindrical wall 4 of the pressure vessel 2 and terminate at dome-shaped windows 118. Each window 118 in terms of area is considerably larger than the cross-sectional area of the wave guide 116 on which it is mounted, and in view of the convex configuration, it encloses a relatively large space immediately beyond the end of the wave guide 116. The window 118 of course is formed from a material that is transparent to microwave energy, yet is strong enough to withstand the force of atmospheric air on its back face, that is the face presented toward the interior of the wave guides 116. In this regard, the microwave energy is produced under atmospheric conditions and transmitted through the wave guides 116 at the pressure as well, because the field strength that can be tolerated without breakdown, that is ionization, is considerably greater under atmospheric conditions than in a high vacuum (see FIG. 4). Thus, the microwave field may be and is in fact highly concentrated in the wave guide 116. The field disperses within the dome-shaped region enclosed by the window 118 and thus passes through the window 118 with less concentration. This decreases the tendency to break down in the low pressure region beyond the window 118. The microwave generator 114 may operate at 2450 MHz.

The septums 12 and 14 and the portions of the cylindrical wall 4 and shield 20 which extend between them define a multimode cavity in which the microwave energy is released at the windows 116. This energy is reflected from the septums 12 and 14 and the intervening portions of the wall 4 and shield 20 until it is absorbed in the product p on the upper pass of the belt 46 or until it attenuates. Actually the microwave energy in the first zone 24 excites water molecules in the product p, and thereby heats the product p, indeed to a temperature in excess of the boiling point for water at the reduced pressure. For example, where the product is grapes, the microwave radiation elevates the temperature of the grapes to between 170° and 200° F. As a consequence the water leaves the product and enters the low pressure chamber 10 as a vapor.

At the location where the upper pass of the endless belt 46 for the conveyor 38 enters the first microwave zone 76 the septum 12 is fitted with chokes 120 that extend along the upwardly and downwardly presented surfaces for the upper pass for the belt 46 and contain notches which are spaced such that microwave energy passing along the belt attenuates fully by the end of the chokes 120. Thus, the loading zone 22 remains free of microwave radiation. Similarly at the location where the belt 46 passes through the next septum 14 to leave the first microwave zone 24 and enter the second zone 26, the septum 14 is provided with more chokes 120 which prevent the microwave radiation within the zone 24 from entering the next zone 26.

As the belt 46 for the upper conveyor 38 carries the product through the first microwave zone 24, the microwave energy in that zone excites the molecules of water in the product and elevates the temperature of that water and the product p as well—indeed to a temperature above the boiling point of the water at the reduced pressure of the chamber 10. This water vapor passes out of the chamber 10 through the vacuum line 106 and is condensed back to liquid water at the condenser 102. Of course the product closest to the septum 12 will have the greatest water content, while the product closest to the septum 14 will have the least, and it is the latter that dictates the power supplied to the first zone 24. In this regard, it will be recalled that as the moisture content of the product decreases, the dielectric factor $\epsilon''$ of the product p likewise decreases. The energy P supplied by the microwave generator 114 remains the same and hence the field strength E increases. Thus, the energy P must be supplied at a magnitude low enough to prevent ionization in the region of least moisture content, which is where the product passes into the chokes 120 at the second septum 14.

The microwave energy for the second microwave zone 26 is derived from another microwave generator 124 which preferably produces its energy at the same frequency as the generator 114. The generator 124 is connected to a pair of wave guides 126 which pass through the cylindrical wall 4 at the second zone 26 and at their ends within the zone 26 are fitted with dome-shaped windows 128 which are similar to the windows 118. The microwave energy produced by the generator 124 passes through the wave guide 126 which is maintained at atmospheric pressure so that a higher field strength may be accommodated. Immediately behind the window 128 the field dissipates somewhat, so that when it passes through the window 128 and into the lower pressure region of the chamber 10, it is less concentrated and less likely to ionize the gas within the second zone 26. The septums 14 and 16 along with the intervening portions of the cylindrical wall 4 and the shield 20 create a multimode cavity, and the microwave energy reflects from those surfaces to eventually be absorbed by that much of the product p which is on the portion of the belt 46 that is in the second zone 26. The chokes 120 at the septum 14 prevent the microwave radiation that is introduced into the second zone 26 from leaking into the first zone 25, while more chokes 120 on the septum 16 prevent the radiation from escaping into the third zone 28.

In absorbing the microwave energy, the product p within the second zone is maintained at a temperature high enough to cause a portion of the moisture within it to boil and escape into the chamber 10, from which it is withdrawn at the vacuum line 106. Since the product p continues to lose moisture as it progresses through the second zone 26, the dielectric loss factor $\epsilon''$ for the product p is least in the region where the product p passes between the chokes 120 at the septum 16. Hence, the field strength E is greatest in that region, and the energy P supplied by the generator 124 must be maintained low enough to keep the field strength E at this critical region below the magnitude at which break down and ionization occur.

The third microwave zone 28 receives its energy from another microwave generator 130 which is located outside of the chamber 10 and directs the energy produced by it into a single wave guide 132 that enters the chamber 10 at the zone 28 and is capped by a dome-shaped window 134. Preferably, the energy is at the same frequency as the energy produced by the second generator 124, although it need not be. Again, the interior of the wave guide 132 is maintained at atmospheric pressure so that the energy may be concentrated therein, that is kept at a high field strength, and the window 134 represents the transition from atmospheric pressure to the low pressure environment of the chamber 10. Upon being discharged through the window 134, the microwave energy reflects from the septums 16 and 18 and the intervening portions of the cylindrical wall 4 and shield 20, and is eventually absorbed in the product p that is on the portion of the belt 46 within the third zone 28. The chokes 120 on the septum 16 prevent this microwave radiation from leaking into the second zone 26, while still more chokes 120 on the last septum 18 prevent the radiation from escaping into the transfer zone 30.

The microwave energy produced by the third generator 130, upon being absorbed by the product p within the third zone, sustains the temperature of the moisture in that product p as well as the product p itself above the boiling point for water at the reduced pressure of the chamber 10, so the moisture continues to escape into the chamber 10 and is withdrawn as vapor through the vacuum line 106. Of course, the product p has its lowest moisture content in the region where it approaches the chokes 120 on the last septum 18. Here the dielectric factor $\epsilon''$ for the product p is lowest and the field strength E is greatest. The energy P produced by the generator 130 must be maintained low enough to prevent the field strength E at the critical downstream region of the product p from exceeding the field strength at which breakdown occurs for the reduced pressure at which the chamber 10 exists. Since the product p may not have a uniform moisture content to begin with and may not dry uniformly in the two preceding zones 24 and 26, a margin for error must be maintained.

Thus, as the product p moves through the chamber 10 on the upper pass of the belt 46 for the upper conveyor 38, it passes in succession through the three microwave zones 24, 26 and 28 where its temperature is elevated above the boiling point for water at the reduced pressure of the chamber 10, and as a consequence the moisture content of the product becomes progressively less. The microwave energy that is supplied by the generators 114, 124 and 130 decreases from zone to zone commensurate with the progressive reduction of the dielectric loss factor $\epsilon''$ for the product p, so that the field strength E in any microwave zone 24, 26 or 28 does not exceed the critical value above which breakdown and ionization occur. Indeed, the energy level in each zone 24, 26 and 28 is kept low enough to provide some margin for error at the downstream end of the zones 24, 26 and 28, so the product p will never be dried to the fullest extent possible in any of the three zones 24, 26 and 28, this being necessary since the product p does not have a uniform moisture content at any given location in any of the three zones 24, 26 and 28 and the moisture content of the product p further may vary at any given location along the conveyor 38 from time to time. The margin for error avoids the possibility of scorching dryer portions by the product p at the downstream ends of the three zones 24, 26 and 28, particularly the last. However, it also results in a discharge of the product p into the transfer zone 30 with perhaps more moisture than is desired.

The excess moisture which remains in the product p as the product p enters transfer zone 30 is removed on the belt 66 of the lower conveyor 40 as that belt moves the product p through the radiant heating zone 34 within the housing 32. In this regard, the housing 32 at the radiant heating zone 34 contains heating panels 136 which lie parallel to the upper pass of the belt 66, both above and below that pass. The panels 136 may contain resistance-type electrical heating elements and are maintained at a temperature close to the limiting temperature of the product p, that is the temperature at which the product p will scorch given the moisture content is possesses. About 20° to 30° F. above the limiting temperature will suffice insofar as most products, including grapes, are concerned. In any event, the excess moisture is driven off at the heating panels 136 which, being sources of radiant heat, will not cause ionization and the problems associated with it.

Unless the moisture which is driven from the product p by the radiant energy is purged from the radiant heating zone 34, the product p will again absorb the moisture within the zone 34. The purge is achieved by introducing a dry or noncondensible gas, such as nitrogen, into the heating chamber 34 through a pipe 138 which passes through the cylindrical wall 4 of the vessel 2 and terminates at two branches 140 within the chamber 10. One of the branches 140 is directed into the space between the two panels 136 near the upstream end of the panels 136. Outside of the vessel 2, the pipe 138 is connected to a source 142 of noncondensible gas through a pressure regulator 144. The gas which is discharged from the pipe 138 flows through the space between the two heated panels 136 and carries away water vapor that is driven from the product p by heat from the panels 136. The gas and water vapor flow out of the housing 32 and into the lower portion of the chamber 10 from which they are evacuated by the vacuum pump 100.

Some products, such as grapes, contain sugars which render the product p quite plastic at temperatures on the magnitude encountered in the heating zone 36. Unless these products p are cooled to recrystallize their sugars, their individual nodules or components will adhere together and collapse upon encountering atmospheric air. Hence, the cooling zone 36 which follows the heating zone 34 within the housing 32. The cooling zone 36 contains two panels 146 which lie parallel to the belt 66 of the lower conveyor 40, with one being above the upper pass of the belt 66 and the other below that pass. The panels 148 through refrigeration equipment (not shown) are maintained at a temperature considerably below that of the product p on the portion of the belt 66 which passes between the panels 146. For example, where the product is grapes, the temperature of the cooling panels 148 may be about 40° F. As a consequence, the product p radiates heat to the panels 148, and its temperature decreases—indeed to the extent that the sugars within the product p recrystalize and the product p assumes a hard solid state. Thus, the product p as it passes through the cooling zone 36 loses its tacky taffy-like consistency and upon emerging from that zone is capable of retaining its shape.

The source of dry gas 142 is connected through its pressure regulator 144 to another pipe 148 having one branch 150 that leads to and discharges into the product accumulator 90 to which the belt 66 directs the dried product. Another branch 150 of the pipe 148 leads to the lock hopper 92 and this branch contains a valve 152. The pipe 148 introduces the noncondensible gas into the accumulator 90 and lock hopper 92 to exclude moisture-laden gas therefrom.

The drying apparatus A may also include a packaging device 160 for placing the dried product P in bags b. The packaging device 160 (FIG. 3) includes rolls 162 of film f on each side of the lock hopper 92. The film f which pays off of these rolls 162 passes over two more closely spaced transition rollers 164 which are separated by a space about as wide as the bag b desired for packaging the product p. Although the lock hopper 92 is located above this space, it does beyond its lower valve 96 have a spout 166 which leads down to that space.

The film f from the rolls 162 extends generally horizontally as it pays off of the rolls 162, but at the transition rollers 164 it turns downwardly so the two lengths of film f are generally parallel. Here the two parallel sections of film are sealed along their side margins and along their bottom margins at heat sealing platens 168 which come together and move apart. This produces the bag b.

Once a bag b is formed, the lower valve 96 of the lock hopper 92 is opened while the upper valve 94 remains closed. Enough product p is allowed to flow from the lock hopper 92 through the spout 166 to fill the bag b, whereupon the valve 96 is then closed. Little, if any, air enters the bag b at this time due to the purge of dry gas from the lock hopper 92.

Thereafter, the bag b advances, whereupon the sealing platens 168 again close to seal the top of the bag b as well as to form the bottom and sides of another bag b. The sealed bag b is then cut away from the preceding bag b, and collected. The foregoing cycle thereupon repeats.

OPERATION

Summarizing the operation of the drying apparatus A, the product p, which may be grapes or some other nodular food product, is mixed with water to form a slurry which in turn is forced by the pump 78 into the reservoir 80 that is within the loading zone 22 of vacuum chamber 10, all without affecting the vacuum within the chamber 10. The conveyor 82 lifts the product p from the reservoir 80, in effect separating it from the water, which is withdrawn by the drain pump 84, and delivers that product to the feed end of the belt 46 for the upper conveyor 38. Immediately after the product p is deposited on the belt 46 the leveling wheel 58 spreads it to achieve a uniform density of product p across the entire width of the belt 46. The belt 46 of the upper conveyor 38 carries the product p through the first, second, and third microwave zones 24, 26 and 28 in that order and delivers it to the transfer zone 30. Of course, the foregoing process is continuous, so a uniform depth of product p exists along the entire length of the belt 46 in the several zones 22, 24, 26, 28, and 30.

Within each of the microwave zones 24, 26 and 28 the product p is subjected to microwave energy of a frequency which excites the molecules of water in the product p, causing the moisture content of the product p and the product p itself to undergo a substantial rise in temperature. Indeed, the temperature is elevated enough in each zone 24, 26 and 28 to bring it to the boiling point of water at the reduced pressure of the chamber 10. Typically, the product enters the first zone 24 at room temperature and leaves that zone at about 120° F.; it leaves the second zone 26 at about 150° F.; and leaves the third zone 28 at between about 170° and 200° F. Since the product p within the first microwave zone 24 has the greatest moisture content, it has the highest dielectric factor $\epsilon''$ and hence can absorb energy at the greatest rate, that is at a rate which is high, yet not so high as to bring the field strength E to a magnitude which causes glow discharge or ionization. As a result, more microwave energy per unit of product p can be introduced into the first zone 24 than into the second zone 26 or third zone 28, and this accounts for the greater number of wave guides 116 and windows 118 in the first zone 24 than either of the succeeding zones 26 and 28.

At each of the zones 24, 26 and 28 enough energy should be introduced into the zone to keep the field strength E somewhat below the field strength at which breakdown or ionization will occur in the critical region of that zone, which is the downstream end of the zone. Thus, the product p leaves the third microwave zone 28 and enters the transfer zone 30 with perhaps more moisture than is desired for the final dried product.

Within the transfer zone 30, the upper conveyor 38 delivers the dried product p to the belt 66 of the lower conveyor 40, and this belt carries the product p through the radiant heating zone 34 and cooling zone 36 within the housing 32. The radiant heating panels 136 at the heating zone 34 radiate heat into the product p, causing the excess moisture to evaporate, so that the product p upon leaving the heating zone 34 possesses the desired moisture content, which in the case of grapes and some other food products is about two percent. The vapor which is released is picked up on the dry purge gas that is introduced into the zone 34 from the pipe 138.

Should the product p contain a sugar which becomes plastic at the elevated temperatures encountered in the microwave zones 24, 26 and 28 or the heating zone 34 during the final drying, the cooling zone 36 is activated. Within this zone the refrigerated panels 146 absorb heat that is radiated from the product p, and the product p undergoes a substantial reduction in temperature—enough to crystalize its sugars and give the product p some rigidity.

Immediately beyond the cooling zone 36, the belt 66 of the lower conveyor 40 discharges the product p into the accumulator 90 where it collects. From time to time the upper valve 94 of the lock hopper 92 is opened, while the lower valve 96 is closed and with the lock hopper 92 at the reduced pressure of vacuum chamber 10, to enable the product p that collects in the accumulator 90 to pass on an intermittent basis into the lock hopper 92.

The product p is thereafter removed from the lock hopper 92, again intermittently, by opening the lower valve 96 while the upper valve 94 and the purge line valve 152 are closed. The product p thus withdrawn may be packaged in bags b at the packaging device 160.

The apparatus A in a similar configuration may be used to dry vegetables that are in a nodular form, such as peas, diced carrots, cut string beans and the like, although with most vegetables, the cooling zone 36 is not necessary, or if it is present, its refrigerated panels 146 need not be activated, because such vegetables do not contain the sugars which render many fruits tacky at the drying temperatures.

Grain seeds are dried in apparatus A similar to vegetables, and depending on the amount of moisture desired in the dried seed, the radiant heating zone 34 may not be used, in which case its heating panels 136 are not activated. Also with grain seeds, a conventional lock hopper may be used to bring the seed into the loading zone 22 instead of the positive displacement pump 78.

The drying of processed meat requires some modifications in the drying apparatus A as hetetofore presented, at least if the drying is to be achieved most effectively. In this regard, processed meats are best dried in the pressure range of from 0.1 to 1.0 Torr. At pressures below about 4.5 Torr any free water in the vacuum chamber 10 immediately freezes. This, of course, eliminates the positive displacement pump 78 and reservoir 80 with the slurry they require. It also eliminates the washing tank 52. Furthermore, the gas purge supplied through the pipe 138 and its branches 140 is not necessary and furthermore makes it difficult to maintain the extremely low pressures desirable for drying processed meat, so that purge is eliminated, and likewise the radiant heating zone 34 and the cooling zone are also probably not necessary.

The condensor 102, inasmuch as it collects liquid water, is not suitable for pressures on the order of 0.1 to 1.0 Torr, so in order to render the apparatus A suitable for drying processed meat, the condensor 102 is either eliminated altogether or replaced with a dual element cryogenic freeze trap. The elements of this type of trap accumulate frost, and are alternated in use, so that while one is active, accumulated frost is being removed from the other.

Most processed meats are at the conclusion of their processing extruded into the shape in which they are ultimately sold, and perhaps cut into slices. Such processed meats may be extruded directly into the loading zone 22 of the chamber 10, and by means of a doctor blade located within the zone, the extrusion is sliced into segments or nodules which drop onto the belt 46 of the conveyor 38 which moves them through the three microwave zones 24, 26 and 28.

So called rotary airlocks or tray lock mechanisms, which are standard items of commerce, may be substituted for the positive displacement pump 78, and the lock hopper 92 as well, particularly where the product p is sliced processed meat.

This invention is intended to cover all changes and modifications of the example of the invention herein chosen for purposes of the disclosure which do not constitute departures from the spirit and scope of the invention.

What is claimed is:

1. A drying apparatus for removing moisture from a product, said apparatus comprising: an air-tight vessel which encloses a chamber that is isolated from the surrounding atmosphere and maintained at a pressure substantially less than that of the surrounding atmosphere;

conveyor means within the chamber for moving the product through the chamber; dividing means extending across the chamber for dividing the chamber into a plurality of successive microwave zones through which the conveyor means moves the product, the dividing means further isolating each zone from the others in the sense that it prevents microwave radiation from passing from one zone to the next; loading means for introducing the moisture-laden product into the chamber without affecting the pressure within the chamber and for further depositing a product on the conveying means; discharge means for collecting the product from the conveyor means and for removing it from the chamber without affecting the pressure within the chamber; and a separate source of microwave energy presented at and directed into each microwave zone for introducing microwave energy into that zone at a frequency capable of exciting the molecules of water which constitute the moisture of the product that is within the zone, the source of microwave energy for any zone supplying the energy at a power density which maintains the field strength in the zone less than that at which ionization will occur within the zone.

2. An apparatus according to claim 1 wherein the conveying means includes a first conveyor which moves the product from the loading zone through the microwave zones in one direction and a second conveyor which is located below the first conveyor and receives the product from the first conveyor beyond the last microwave zone, the second conveyor moving in the opposite direction from the first conveyor to carry the product below the first conveyor; and further comprising a shield within the chamber and being substantially opaque to microwave radiation, the shield isolating the second conveyor from the microwave radiation so that the second conveyor operates in a region that is substantially free of microwave radiation.

3. An apparatus according to claim 2 and further comprising means along the second conveyor for heating the product radiantly while it is on that conveyor.

4. An apparatus according to claim 1 wherein the source of microwave energy for each zone comprises a separate microwave generator and a wave guide for directing the microwave energy produced by that generator into the chamber at the zone with which it is associated.

5. An apparatus according to claim 4 wherein the microwave generators are located outside of the chamber and the microwaves produced by the generators pass through the wave guides at atmospheric pressure.

6. An apparatus according to claim 5 wherein each wave guide terminates at a window that is transparent to the microwave energy transmitted by the wave guide, the window being impervious and exposed to the interior of the wave guide on one of its faces and to the chamber on the other of its faces, whereby said one face is at atmospheric pressure, the microwave energy that is transmitted by the wave guide to the window being emitted on the side of the window that is at atmospheric pressure and thence passing through the window into the region of reduced pressure within the chamber.

7. An apparatus according to claim 4 wherein the conveyor means includes a first endless belt having a conveying pass that moves through each of the zones and is exposed to the microwave radiation in each zone.

8. An apparatus according to claim 7 wherein the dividing means includes septums which extend across the chamber and separate the zones from each other; and wherein the conveying pass of the belt extends through the septums.

9. An apparatus according to claim 8 wherein the dividing means further comprise microwave chokes where the conveying pass of the endless belt passes through the septums.

10. An apparatus according to claim 7 wherein the endless belt also has a return pass, and further comprising a shield beyond which the return pass is located, the shield being opaque to microwave radiation and preventing such radiation from reaching the return pass.

11. An apparatus according to claim 10 and further comprising means located beyond the shield for washing the belt along the return pass thereof.

12. An apparatus according to claim 1 wherein the dividing means also form within the chamber end zones that are substantially free from microwave radiation; and wherein the loading means is in one of such end zones.

13. An apparatus according to claim 26 wherein the radiant heating means comprises heated panels along the conveying means.

14. An apparatus according to claim 26 and further comprising means for introducing a dry purge gas into the chamber at the radiant heating means to carry away from the product water vapor that is released from the product at the radiant heating means.

15. An apparatus according to claim 26 wherein the conveying means includes a first conveyor which moves the product from the loading zone through the microwave zones in one direction and a second conveyor which receives the product from the first conveyor at a location beyond the last microwave zone and carries the product past the radiant heating means and to the discharge means.

16. An apparatus according to claim 15 and further comprising cooling means located along the second conveyor between the radiant heating means and discharge means for cooling the product after it leaves the radiant heating means.

17. An apparatus according to claim 16 and further comprising means for introducing a dry gas into the chamber at the radiant heating means to carry away water vapor released from the product at the radiant heating means and also at the cooling means to prevent condensation on cold surfaces at the cooling means.

18. An apparatus according to claim 15 wherein the second conveyor is located below the first conveyor and moves the product in a direction opposite to the direction which the first conveyor moves the product.

19. An apparatus according to claim 1 and further comprising cooling means located within the chamber along the conveying means for absorbing heat from the product after the product leaves the microwave zones and before it enters the discharge means.

20. A process for drying a product, said process comprising: introducing a moist product into a chamber that is maintained at a pressure substantially lower than atmospheric without affecting the pressure of the chamber; moving the product at a generally uniform velocity along a path that extends through the chamber; subjecting the product to microwave energy while it moves through the chamber, with the energy being at a frequency which excites the molecules of moisture in the product, so that the moisture within the product vaporizes and enters the chamber, the microwave energy being confined to zones located along the path that the product moves, with each zone being isolated in the sense that microwave radiation in it will generally not escape into an adjacent zone, each zone deriving its microwave energy from a source of microwave energy that is separate and distinct from the source of microwave energy for any other zone, the source of microwave energy for any zone supplying that energy at a power density which maintains the field strength in the zone below that required for ionizing gas within the chamber, whereby glow discharge is avoided; and removing the dried product from the chamber without affecting the pressure of the chamber.

21. The process according to claim 22 wherein the density of the microwave energy in terms of power per unit volume of product diminishes with successive zones.

22. The process according to claim 21 wherein the product along the path is dispersed on a supporting surface that extends through the zones and is of generally uniform height and width on that supporting surface.

23. The process according to claim 21 wherein the supporting surface is an endless belt that is transparent to the microwave energy and has a conveying pass and a return pass, with the product being supported on the conveying pass.

24. The process according to claim 23 and further comprising passing a dry purge gas along the product while subjecting it to radiant heat so as to carry away moisture released from the product.

25. The process according to claim 19 and further comprising cooling the product within the chamber after it is heated.

26. A drying apparatus for removing moisture from a product, said apparatus comprising: an air-tight vessel which encloses an elongated chamber that is isolated from the surrounding atmosphere and maintained at a pressure substantially less than the surrounding atmosphere; conveyor means within the chamber for moving the product through the chamber; dividing means extending across the chamber for dividing the chamber into a plurality of microwave zones through which the conveyor means moves the product, the dividing means further isolating each zone from the others in the sense that it prevents microwave radiation from passing from one zone to the next; loading means for introducing the moisture-laden product into the chamber without affecting the pressure within the chamber and for further depositing a product on the conveying means; discharge means for collecting the product from the conveyor means and for removing it from the chamber without affecting the pressure within the chamber; power means for introducing microwave energy into each of the microwave zones at a frequency capable of exciting the molecules of water which constitute the moisture, and radiant heating means within the chamber for emitting radiant heat, the radiant heating means being along the conveying means beyond the last microwave zone and ahead of the discharge means so that the conveying means carries the product past the radiant heating means before the product is removed from the chamber.

27. A process for drying a product, said process comprising: introducing a moist product into a chamber that is maintained at a pressure substantially lower than atmospheric without affecting the pressure of the chamber; moving the product at a generally uniform velocity along a path that extends through the chamber; subjecting the product to microwave energy while it moves through the chamber, with the energy being at a frequency which excites the molecules of moisture in the product, so that the moisture within the product vaporizes and enters the chamber, the microwave energy being confined to zones along the path that the product moves, with the strength of the microwave field in each zone being below that required for ionizing gas within the chamber, whereby glow discharge is avoided; heating the product with radiant heat within the chamber beyond the last microwave zone to cause more moisture to be released by the product; and removing the dried product from the chamber without affecting the pressure of the chamber.

28. A process for drying a product, said process comprising: introducing a moist product into a chamber that is maintained at a pressure substantially lower than atmospheric without affecting the pressure of the chamber; moving the product at a generally uniform velocity along a path that extends through the chamber; subjecting the product to microwave energy while it moves through the chamber, with the energy being at a frequency which excites the molecules of moisture in the product, so that the moisture within the product vaporizes and enters the chamber, the microwave energy being confined to zones along the path that the product moves, with the strength of the microwave field in each zone being below that required for ionizing gas within the chamber, whereby glow discharge is avoided; cooling the product within the chamber after it is heated; passing a dry purge gas along the product as it is cooled; and removing the dried product from the chamber without affecting the pressure of the chamber.

* * * * *

UNITED STATES PATENT AND TRADEMARK OFFICE

CERTIFICATE OF CORRECTION

PATENT NO. : 4,640,020

DATED : February 3, 1987

INVENTOR(S) : Frederick C. Wear and Howard F. McKinney

It is certified that error appears in the above-identified patent and that said Letters Patent is hereby corrected as shown below:

Column 6, line 49, "scaper" should be "scraper".

Column 13, line 47, "on" should be "in".

Column 17. line 12, claim 21 should depend from claim 20 and not claim 22.

Column 17. line 26, claim 24 should depend from claim 27 and not claim 23.

Column 17, line 30, claim 25 should depend from claim 27 and not claim 19.

Signed and Sealed this

Twenty-first Day of April, 1987

*Attest:*

DONALD J. QUIGG

*Attesting Officer*

*Commissioner of Patents and Trademarks*